US012590406B2

(12) United States Patent
Li et al.

(10) Patent No.: US 12,590,406 B2
(45) Date of Patent: Mar. 31, 2026

(54) HEATING UNIT, HEATING INNER CHAMBER AND HANGING IRONING MACHINE

(71) Applicant: Shenzhen Beibanqiu Network Technology Co, Ltd, Shenzhen (CN)

(72) Inventors: Jin Li, Shenzhen (CN); Minghe Pan, Shenzhen (CN)

(73) Assignee: Shenzhen Beibanqiu Network Technology Co, Ltd., Shenzhen (CN)

( * ) Notice: Subject to any disclaimer, the term of this patent is extended or adjusted under 35 U.S.C. 154(b) by 0 days.

(21) Appl. No.: 19/077,011

(22) Filed: Mar. 11, 2025

(65) Prior Publication Data

US 2025/0207319 A1 Jun. 26, 2025

(30) Foreign Application Priority Data

Feb. 14, 2025 (CN) ..... 202520245776.3

(51) Int. Cl.
*D06F 69/00* (2006.01)

(52) U.S. Cl.
CPC ..... *D06F 69/00* (2013.01)

(58) Field of Classification Search
CPC ..... D06F 75/10; D06F 73/00; D06F 69/00; D06F 75/24
See application file for complete search history.

(56) References Cited

U.S. PATENT DOCUMENTS 3,134,182 A * 5/1964 Morton ..... D06F 75/24 392/397
4,747,222 A * 5/1988 Riba ..... D06F 75/26 392/397
2023/0243087 A1* 8/2023 Yu ..... D06F 75/24 68/222

FOREIGN PATENT DOCUMENTS

CN 113390076 A * 9/2021 ..... D06F 73/00
CN 116219716 A * 6/2023 ..... D06F 73/00
CN 309142285 S 2/2025

* cited by examiner

*Primary Examiner* — Nathan E Durham
(74) *Attorney, Agent, or Firm* — JEEN IP LAW, LLC

(57) ABSTRACT

The present invention belongs to the technical field of electrical appliances, especially relates to a heating unit, a heating inner chamber and a hanging ironing machine, wherein the heating unit comprises an integrated heating tube, the integrated heating tube is in a continuous and double-layers stacked shape, and a single-layer structure of the integrated heating tube is configured to include at least two sections of straight tubes that extend along a length direction. Through reasonable spatial structure, a total length of a single tube is increased as much as possible in the range of small space, thereby increasing the maximum power of the whole heating tube, thus to prevent damage and safety hazards caused by excessive currents and powers due to unstable control voltages.

6 Claims, 5 Drawing Sheets

HEATING UNIT, HEATING INNER CHAMBER AND HANGING IRONING MACHINE

RELATED APPLICATIONS

The present patent document claims the benefit of priority to patent application No. 202520245776.3, filed Feb. 14, 2025, and entitled "HEATING UNIT, HEATING INNER CHAMBER AND HANGING IRONING MACHINE," the entire content of which is incorporated herein by reference.

BACKGROUND

1. Technical Field

The present invention relates to the technical field of electrical appliances, and in particular to a heating unit, a heating inner chamber and a hanging ironing machine.

2. Background Information

A hanging ironing machine is also called hanging iron or vertical iron. The hanging ironing machine heats water in a heating chamber through an internal heating element, so that the generated hot water vapor constantly contacts the clothes and fabric to achieve the purpose of ironing. In order to meet the needs of different countries, most of the hanging ironing machines on the current market can be automatically compatible with wide voltages by means of adopting a double heating tube structure, one of the heating tubes is powered by 100~120V, and the other is powered by 220~240V. The input voltage is identified by the device's motherboard, and the heating tube is selected through switching the hardware and software, thereby achieving dual voltage compatibility. Although this structure is simple, the disadvantage is that two segments of independent heating tubes are required, that is, two pairs of input and output ports, resulting in more complicated internal connections, large equipment volume and high cost. Besides, if one of the heating tubes fails, the other becomes unusable as well, resulting in waste.

BRIEF SUMMARY

The purpose of the present invention is to provide a heating unit adopting a single tube and double-layers structure, which can be compatible with use demands, optimize space utilization, and simplify the device volume easily.

Based on this, the present invention provides a heating unit, comprising an integrated heating tube, wherein the integrated heating tube is in a continuous and double-layers stacked shape, and a single-layer structure of the integrated heating tube is configured to include at least two sections of straight tubes that extend along a length direction.

The heating unit as described above, the integrated heating tube includes a first straight tube, a second straight tube, a third straight tube, a fourth straight tube, a first connecting section and a second connecting section;

The first connecting section is connected between a tail end of the first straight tube and a head end of the second straight tube, the second connecting section is connected at a tail end of the third straight tube and a head end of the fourth straight tube, and a tail end of the second straight tube is connected with a head end of the third straight tube. The second straight tube and the third straight tube are arranged in a parallel and stacked configuration, and the first straight tube and the fourth straight tube are arranged in a parallel and stacked configuration.

The heating unit as described above, the first straight tube is arranged in parallel with the second straight tube, and the first connecting section is a curved connecting end, so that the single-layer structure of the integrated heating tube is configured as a U-shaped structure.

The heating unit as described above, a head end of the first straight tube is aligned with a tail end of the fourth straight tube, and both ends are provided with a mating end.

The present invention further provides a heating inner chamber, comprising a housing. The housing has an upper-layer inner chamber and a lower-layer inner chamber, the upper-layer inner chamber is communicated with the lower-layer inner chamber, and a heating unit is provided between the upper-layer inner chamber and the lower-layer inner chamber within the housing. An upper layer of the heating unit is used to heat the upper-layer inner chamber, and a lower layer of the heating unit is used to heat the lower-layer inner chamber.

The heating inner chamber as described above, the housing includes an upper housing and a lower housing, the upper housing is connected to an upper side of the lower housing, and connecting end faces between the upper housing and the lower housing forms a first interlayer for accommodating the upper layer of the heating unit.

The heating inner chamber as described above, the upper housing or the lower housing is directly formed on an outer side of the single-layer structure of the integrated heating tube.

The heating inner chamber as described above, the lower housing is directly formed on an outer side of the lower-layer structure of the integrated heating tube, and an upper end face thereof forms an accommodating groove that half encloses the upper structure of the integrated heating tube. A lower end of the upper housing has a recess for matching with the accommodating groove, and the recess and the accommodating groove together form the first interlayer. The upper-layer inner chamber is located at an upper end of the upper housing and near the first interlayer, and the lower-layer inner chamber is located at a lower side of the lower housing.

The heating inner chamber as described above, the accommodating groove is matched with the contour of the single-layer structure of the integrated heating tube and has a first port and a communicating port, the first port allows the mating end of the integrated heating tube to extend outward, and the communicating port allows the tail end of the second straight tube to bend to the head end of the third straight tube for connection.

The present invention further provides a hanging ironing machine, comprising a machine body, the machine body is provided with the above-mentioned heating inner chamber.

The following beneficial effects can be achieved by the embodiment of the present invention.

1. The present invention provides a heating unit, which uses an integrated heating tube and optimizes the spatial structure, so that a total length of a single tube is increased as much as possible in the range of small space, thereby increasing the maximum power of the whole heating tube, thus to prevent damage and safety hazards caused by excessive currents and powers due to unstable control voltages.

2. The present invention provides a heating inner chamber, which is applied to the ironing products. By using the above-mentioned heating unit, a double-layers heating tube can be arranged in a compact space and a single layer heating inner chamber can be heated and used separately, the heating efficiency is high, which is particularly suitable for use in the hanging ironing machine with miniaturization design.

BRIEF DESCRIPTION OF THE DRAWINGS

In order to more clearly illustrate the technical solutions in the embodiments of the present invention, drawings that need to be used in the embodiments are briefly described below, and it is obvious that the drawings in following description are merely some embodiments of the present invention, and for those who skilled in the art, other drawings can be obtained based on these drawings without exerting creative efforts.

DETAILED DESCRIPTION OF THE DRAWINGS AND THE PRESENTLY PREFERRED EMBODIMENTS

The technical solutions in the embodiments of the present invention will be clearly and completely described hereafter in conjunction with the accompanying drawings in the embodiments of the present invention. Apparently, the described embodiments are merely a part of the embodiments of the present invention, rather than all the embodiments. Based on the embodiments of the present invention, all other embodiments obtained by those skilled in the art without creative work shall fall within the protection scope of the present invention.

Figure 1:
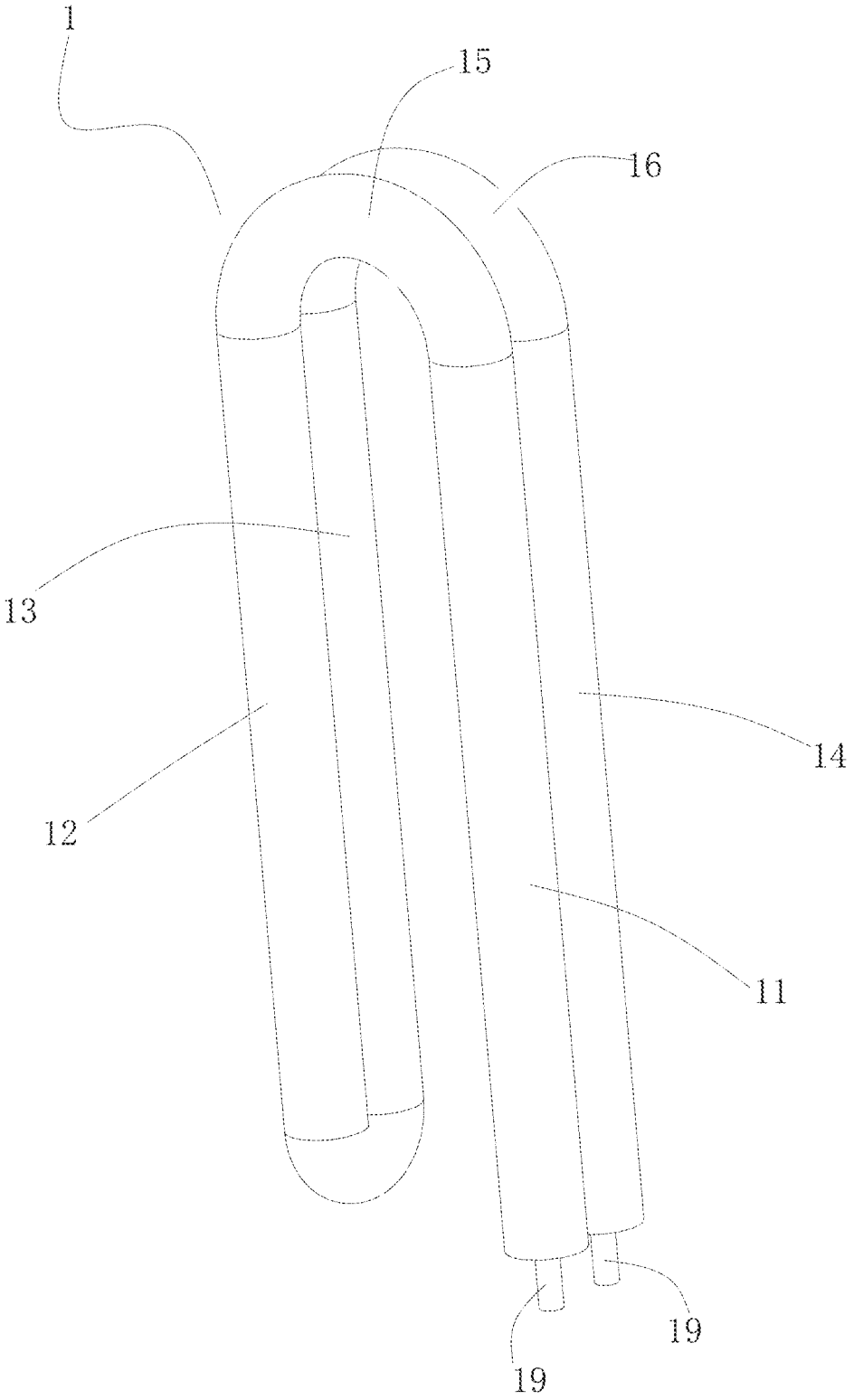
FIG. 1 is a structural schematic of a heating unit of the present invention.
Figure 2:
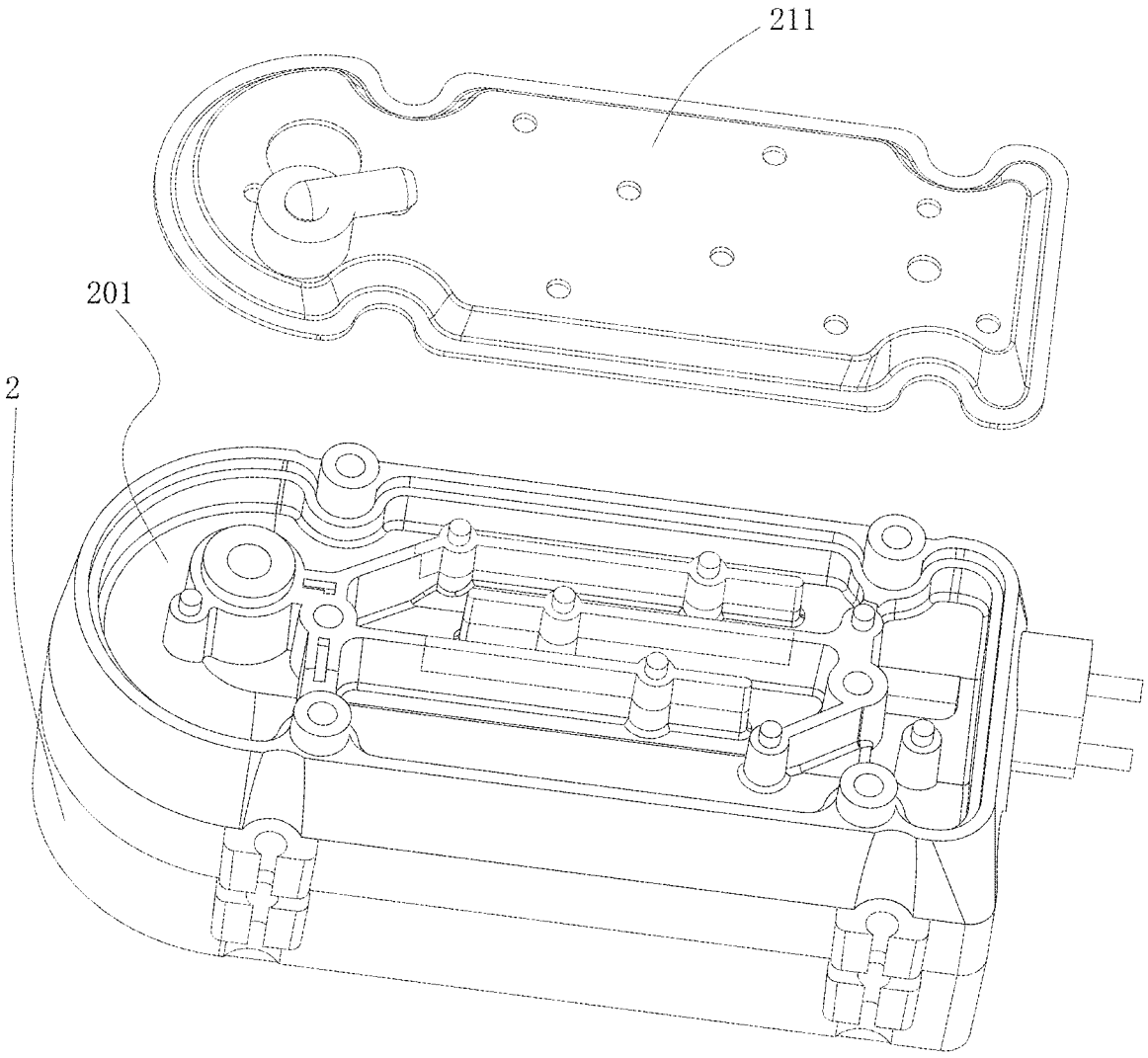
FIG. 2 is an exploded view of a heating chamber of the present invention.
Figure 3:
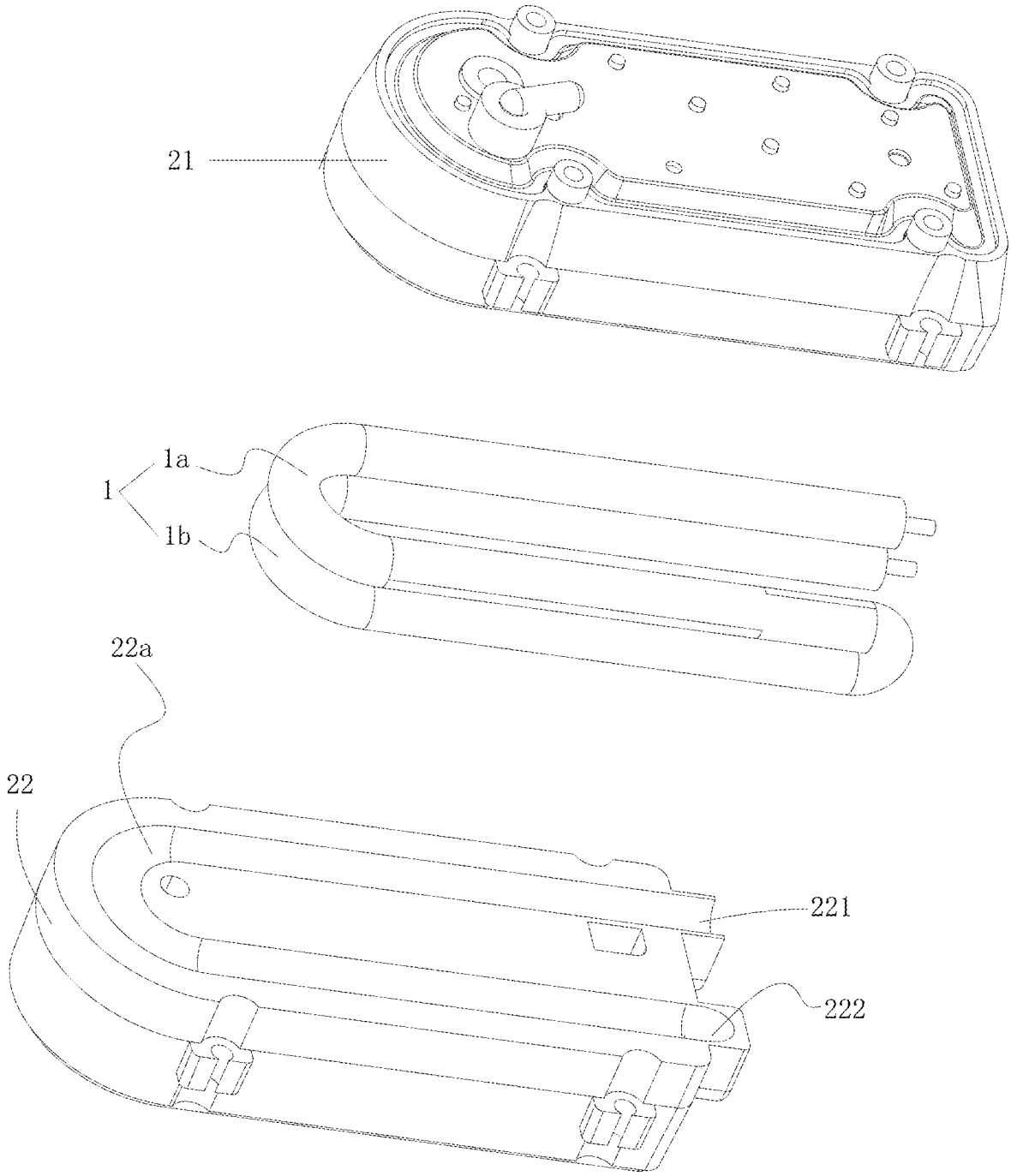
FIG. 3 is another exploded view of the heating chamber of the present invention.
Figure 4:
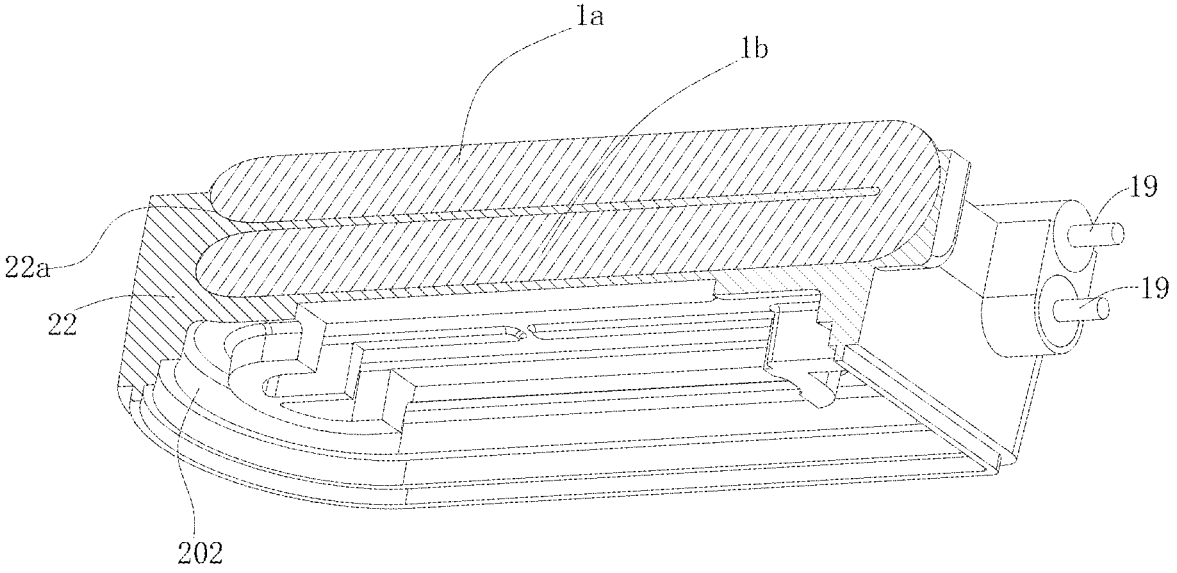
FIG. 4 is a cross-sectional view of a heating unit and a lower housing.
Figure 5:
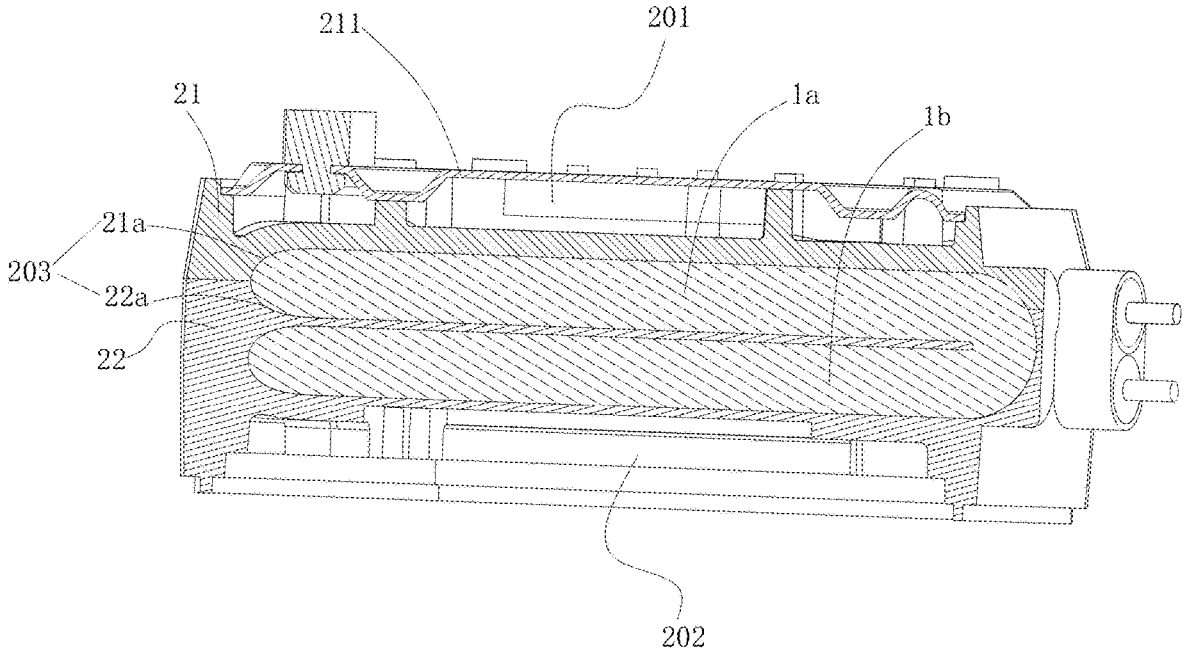
FIG. 5 is a cross-sectional view of a heating inner chamber.

As shown in FIG. 1, the present invention provides a heating unit, which comprises an integrated heating tube 1. The integrated heating tube 1 is in a continuous and double-layers stacked shape, and a single-layer structure of the integrated heating tube 1 is configured to include at least two sections of straight tubes that extend along a length direction. The present invention optimizes the spatial structure, so that a total length of a single tube is increased as much as possible in the range of small space, thereby increasing the maximum power of the whole heating tube, thus to prevent damage and safety hazards caused by excessive currents and powers due to unstable control voltages. Compared with the traditional bending coil structure or mosquito-like folding tube structure, this solution adopts a double-layers single-tube integrated arrangement structure, the single-layer structure is simpler, allowing for an increase in the tube diameter while avoiding the inconvenience of excessive bending due to overly large diameters. Additionally, this design enhances the power capacity of the tube, making it more compatible for various applications.

It should be noted that in different countries, voltage specifications range from 120V to 240V. Generally, the heating tubes need to be compatible with 120V, 220V, and 240V. In devices such as irons and hanging ironing machines, the power requirement for the heating tubes is typically limited to 1000 W to avoid safety hazards caused by excessive powers. Currently, some designs use a single heating tube rated for 120V, which can be directly used when the input voltage is 120V. However, if used directly with higher voltages, the heating tube would burn out, and the hanging ironing machines will be damaged. Software is often used to identify the input voltage and process 220V~240V input through methods like chopping or wave dropping so as to achieve dual-voltage compatibility. The drawback of this method is that when operating at 220V~240V, the software processing can cause voltage instability and instantaneous high current, and a 120V/1000 W heating tube has an internal resistance of 14.4 ohms. When the input voltage is 220V~240V, the maximum current through the heating tube can reach about 16 A, and the maximum power can reach 3600 W, which impacts the service life of the product and poses safety risk.

By adopting the double-layers structure design, this solution supports a voltage range of 220V~240V, preferably 230V. The arrangement of the double-layers structure can maximize the length of the heating tube, and the power of the heating tube is 3700 W. This design meets the requirement that higher power necessitates a longer heating tube, while keeping the product's internal resistance at approximately 14.4 ohms. When the input voltage is 220V~240V, the software reduces the power to 1000 W, ensuring a current of less than 8.5 A for safe operation. When the input voltage is 120V, the software does not limit the power, the power is about 1000 W, and the current is less than 8.5 A, which is also safer.

This solution provides a rational double-layers structure to improve the arrangement of a single heating tube, so that it can achieve greater length within a compact space, thus to increase the power it can withstand. When operating under high voltage, even in cases of voltage instability or power surges, the design can effectively prevent damages or safety incidents caused by instantaneous excessive voltages.

Of course, in the embodiment of the present invention, the single-layer structure is configured to include at least two sections of straight tubes, which does not require multiple bending and improves the overall service life of the products. Additionally, the straight tubes arranged along the length direction are well suited for use in compact hanging ironing machines, and fit snugly within their heating chambers. Of course, the two sections of straight tubes can also be arranged within a single layer. Preferably, the two sections of straight tubes in this solution are arranged in parallel, and the structure of the other layer is essentially identical to this layer, forming a double-layers stacked structure.

Specifically, the integrated heating tube 1 includes a first straight tube 11, a second straight tube 12, a third straight tube 13, a fourth straight tube 14, a first connecting section 15 and a second connecting section 16. The first connecting section 15 is connected between a tail end of the first straight tube 11 and a head end of the second straight tube 12, the second connecting section 16 is connected at a tail end of the third straight tube 13 and a head end of the fourth straight tube 14, and a tail end of the second straight tube 12 is connected with a head end of the third straight tube 13. The second straight tube 12 and the third straight tube 13 are arranged in a parallel and stacked configuration, and the first straight tube 11 and the fourth straight tube 14 are arranged in a parallel and stacked configuration. The double-layers and simple double-tube folded structure can be understood as a single section of heating tube being folded at the first connecting section 15 to form the first straight tube 11 and the second straight tube 12, a rear section of the second straight tube 12 being bent a second time to form the third straight tube 13, and the second connecting section 16 being folded to form the fourth straight tube 14, thereby forming the above-mentioned compact three-dimensional arrangement design.

In the embodiment of the present invention, preferably, the first straight tube 11 is arranged in parallel with the second straight tube 12, and the first connecting section 15 is a curved connecting end, so that the single-layer structure of the integrated heating tube 1 is configured as a U-shaped structure. The above design is based on the shape design of the double U-shaped heat tubes, which can achieve the maximum length of the heating tube in a compact space.

In addition, for ease of use, in the embodiment of the present invention, a head end of the first straight tube 11 is aligned with a tail end of the fourth straight tube 14, and both ends are provided with a mating end 19. The mating end 19 of this solution is an electrical connection end, which is convenient to power and mate with the control module. Besides, the double-layers heating tube of this solution can be used by only connecting a set of connecting ends, which greatly simplifies the internal lines and wire connections compared with the structure of the double-heating tubes.

Based on this, the present invention provides a heating unit, which uses an integrated heating tube and optimizes the spatial structure, so that a total length of a single tube is increased as much as possible in the range of small space, thereby increasing the maximum power of the whole heating tube, thus to prevent damage and safety hazards caused by excessive currents and powers due to unstable control voltages.

As shown in FIG. 2 to FIG. 5, as an application, the present invention further provides a heating inner chamber, which comprise a housing 2. The housing 2 has an upper-layer inner chamber 201 and a lower-layer inner chamber 202, the upper-layer inner chamber 201 is communicated with the lower-layer inner chamber 202. A heating unit as described above is provided located between the upper-layer inner chamber 201 and the lower-layer inner chamber 202 within the housing 2, an upper layer 1*a* of the heating unit is used to heat the upper-layer inner chamber 201, and a lower layer 1*b* of the heating unit is used to heat the lower-layer inner chamber 202. The heating inner chamber is applied to ironing products. By using the above-mentioned heating unit, a double-layers heating tube can be arranged in a compact space and a single layer heating inner chamber can be heated and used separately, the heating efficiency is high, which is particularly suitable for use in the hanging ironing machine with miniaturization design.

When used, after adding water, the water flow enters the upper-layer inner chamber 201 and flows through the upper-layer inner chamber 201 into the lower-layer inner chamber 202, and in this process, water vapor is formed by heating and discharged from steam ports corresponding to the lower side of the lower-layer inner chamber 202. In this solution, through the double-layers heating tube structure, the design position of the upper layer structure can heat the upper-layer inner chamber 201, similarly, the design position of the lower layer structure can heat the lower-layer inner chamber 202, which can improve the heating efficiencies of the two inner chambers, thereby improving the whole heating efficiencies, and by matching with the double-layers structure of the heating elements, the space is fully used.

Specifically, in the embodiment of the present invention, the housing 2 includes a upper housing 21 and a lower housing 22, the upper housing 21 is connected to an upper side of the lower housing 22, and connecting end faces between the upper housing 21 and the lower housing 22 forms a first interlayer 203 for accommodating the upper layer of the heating unit. The structure of the split-type housing is mainly convenient for installation and assembly. However, since this solution adopts the integrated double-layers heating tube to improve the heating efficiency, the heating tube is arranged within the housing. As a result, the installation method differs from conventional assembly. Preferably, the upper housing 21 or the lower housing 22 is directly formed on an outer side of the single-layer structure of the integrated heating tube 1. It can be understood that by directly forming half housing on the single layer of the heating tube, the other layer is exposed on the outside of the half housing, and then assembling the other half of housing, the heating element can be wrapped inside to form the assembly.

In the embodiment of the present invention, preferably, the lower housing 22 is directly formed on an outer side of the lower-layer structure 1*b* of the integrated heating tube 1, and an upper end face thereof forms an accommodating groove 22*a* that half encloses the upper structure of the integrated heating tube 1. A lower end of the upper housing 21 has a recess 21*a* for matching with the accommodating groove 22*a*, and the recess 21*a* and the accommodating groove 22*a* together form the first interlayer 203. The upper-layer inner chamber 201 is located at an upper end of the upper housing 21 and near the first interlayer 203, and the lower-layer inner chamber 202 is located at a lower side of the lower housing 22.

In order to facilitate the installation, the accommodating groove 22*a* is matched with the contour of the single-layer structure of the integrated heating tube 1 and has a first port 221 and a communicating port 222, the first port 221 allows the mating end 19 of the integrated heating tube 1 to extend outward, and the communicating port 222 allows the tail end of the second straight tube 12 to bend to the head end of the third straight tube 13 for connection.

Of course, in this solution, the upper-layer inner chamber 201 is provided with an upper cover 211. A water inlet on the upper cover 211, which is convenient for users to add water directly from the outside to the upper-layer inner chamber 201. At the same time, it also ensures that the water enters the upper-layer inner chamber 201 at a specified position after adding water, so that the water must pass through a specified path to flow to the lower-layer inner chamber 202, thus to ensure its heating effects.

The present invention further provides a hanging ironing machine which comprises a machine body. The machine body adopts the above-mentioned heating inner chamber. Similarly, the integrated heating tube is arranged within the heating inner chamber. With its reasonable design, the volume design of the hanging ironing machine can be further reduced without restrictions, which can meet the needs of different voltages in various countries.

It should be understood that the terms "first" and "second" in the present invention are used to describe various information, but the information should not be limited to these terms, and these terms are only used to distinguish the same type of information from each other. For example, in the case of without departing from the scope of the present disclosure, a "first" information may also be called a "second" information, and similarly, the "second" information may also be called the "first" information. In addition, the terms "center", "upper", "lower", "left", "right", "vertical", "horizontal", "inner", "outer", etc. indicating the direction or position relationship are based on the direction or position relationship shown in the drawings, and those terms are just convenient to describe the disclosure and to simplify the description, but not to indicate or imply that the device or the component must have a specific direction, or have been constructed and operated in a specific direction. Therefore, it should not be interpreted as limiting to the present application.

The above described are preferred implementation methods of the present invention. It should be pointed out that for ordinary technicians in this technical field, some improvements and deformations can be made without breaking away from the principles of the present invention, and these improvements and deformations are also regarded as the protection scope of the present invention.

What is claimed is:

1. A heating inner chamber, comprising a housing, wherein the housing has an upper-layer inner chamber and a lower-layer inner chamber, the upper-layer inner chamber is communicated with the lower-layer inner chamber, and a heating unit is configured between the upper-layer inner chamber and the lower-layer inner chamber within the housing, an upper layer of the heating unit is used for heating the upper-layer inner chamber, and a lower layer of the heating unit is used for heating the lower-layer inner chamber;

wherein the heating unit comprises an integrated heating tube, wherein the integrated heating tube is in a continuous and double-layers stacked shape, and a single-layer structure of the integrated heating tube is configured to include at least two sections of straight tubes that extend along a length direction;

wherein the housing includes an upper housing and a lower housing, the upper housing is connected to an upper side of the lower housing, and connecting end faces between the upper housing and the lower housing forms a first interlayer for accommodating the upper layer of the heating unit;

wherein the upper housing or the lower housing is formed fitting with an outer side of the single-layer structure of the integrated heating tube;

wherein the lower housing is formed fitting with an outer side of a lower-layer structure of the integrated heating tube, and an upper end face thereof forms an accommodating groove that half encloses the lower-layer structure of the integrated heating tube, a lower end of the upper housing has a recess for matching with the accommodating groove, and the recess and the accommodating groove together form the first interlayer, the upper-layer inner chamber is located at an upper end of the upper housing and near the first interlayer, and the lower-layer inner chamber is located at a lower side of the lower housing.

2. The heating inner chamber according to claim 1, wherein the integrated heating tube includes a first straight tube, a second straight tube, a third straight tube, a fourth straight tube, a first connecting section and a second connecting section;

the first connecting section is connected between a tail end of the first straight tube and a head end of the second straight tube, the second connecting section is connected at a tail end of the third straight tube and a head end of the fourth straight tube, a tail end of the second straight tube is connected with a head end of the third straight tube;

the second straight tube and the third straight tube are configured to be parallel and stacked with each other, and the first straight tube and the fourth straight tube are configured to be parallel and stacked with each other.

3. The heating inner chamber according to claim 2, wherein the first straight tube is arranged in parallel with the second straight tube, and the first connecting section is a curved connecting end, so that the single-layer structure of the integrated heating tube is configured as a U-shaped structure.

4. The heating inner chamber according to claim 3, wherein a head end of the first straight tube is aligned with a tail end of the fourth straight tube, and both ends are provided with a mating end.

5. The heating inner chamber according to claim 1, wherein the accommodating groove is matched with a contour of the single-layer structure of the integrated heating tube and has a first port and a communicating port, the first port allows the mating end of the integrated heating tube to extend outward, and the communicating port allows the tail end of the second straight tube to bend to the head end of the third straight tube for connection.

6. A hanging ironing machine, comprising a machine body, wherein the machine body is provided with a heating inner chamber, wherein the heating inner chamber comprises a housing, wherein the housing has an upper-layer inner chamber and a lower-layer inner chamber, the upper-layer inner chamber is communicated with the lower-layer inner chamber, and a heating unit is configured between the upper-layer inner chamber and the lower-layer inner chamber within the housing, an upper layer of the heating unit is used for heating the upper-layer inner chamber, and a lower layer of the heating unit is used for heating the lower-layer inner chamber;

wherein the heating unit comprises an integrated heating tube, wherein the integrated heating tube is in a continuous and double-layers stacked shape, and a single-layer structure of the integrated heating tube is configured to include at least two sections of straight tubes that extend along a length direction;

wherein the housing includes an upper housing and a lower housing, the upper housing is connected to an upper side of the lower housing, and connecting end faces between the upper housing and the lower housing forms a first interlayer for accommodating the upper layer of the heating unit;

wherein the upper housing or the lower housing is directly formed on an outer side of the single-layer structure of the integrated heating tube;

wherein the lower housing is directly formed on an outer side of a lower-layer structure of the integrated heating tube, and an upper end face thereof forms an accommodating groove that half encloses the upper layer structure of the integrated heating tube, a lower end of the upper housing has a recess for matching with the accommodating groove, and the recess and the accommodating groove together form the first interlayer, the upper-layer inner chamber is located at an upper end of the upper housing and near the first interlayer, and the lower-layer inner chamber is located at a lower side of the lower housing.

* * * * *